US005184579A

United States Patent [19]

Fujiwara

[11] Patent Number: 5,184,579

[45] Date of Patent: Feb. 9, 1993

[54] CYLINDER HEAD STRUCTURE OF INTERNAL COMBUSTION ENGINE

[75] Inventor: Hideo Fujiwara, Shizuoka, Japan

[73] Assignee: Suzuki Motor Corporation, Shizuoka, Japan

[21] Appl. No.: 835,128

[22] Filed: Feb. 12, 1992

[30] Foreign Application Priority Data

Feb. 22, 1991 [JP] Japan ..... 3-50760

[51] Int. Cl.[5] ..... F01L 1/26

[52] U.S. Cl. ..... 123/90.23; 123/90.27; 123/55 V

[58] Field of Search ..... 123/90.22, 90.23, 90.27, 123/55 VF, 55 VS, 55 VE, 55 V, 308, 315, 432

[56] References Cited

U.S. PATENT DOCUMENTS

| | | | |
|---|---|---|---|
| 4,714,058 | 12/1987 | Oda et al. | 123/90.22 |
| 4,739,734 | 4/1988 | Honda et al. | 123/90.22 |
| 4,739,735 | 4/1988 | Ichida et al. | 123/90.23 |
| 4,969,427 | 11/1990 | Hamada | 123/90.27 |
| 4,995,352 | 2/1991 | Machino | 123/90.27 |
| 5,027,761 | 7/1991 | Fujii et al. | 123/90.23 |
| 5,101,777 | 4/1992 | Onishi et al. | 123/90.23 |

FOREIGN PATENT DOCUMENTS

| | | |
|---|---|---|
| 1-193009 | 8/1989 | Japan . |
| 1-136611 | 9/1989 | Japan . |
| 1-280605 | 11/1989 | Japan . |

*Primary Examiner*—E. Rollins Cross
*Assistant Examiner*—Weilun Lo
*Attorney, Agent, or Firm*—Flynn, Thiel, Boutell, Tanis

[57] ABSTRACT

First and second cam shafts arranged in first and second cylinder heads of a V-shaped internal combustion engine are respectively arranged so as to be offset toward the inner side of the internal combustion engine in the width directions of the first and second cylinder heads. First and second exhaust valves and first and second spark plugs are arranged so as to be almost parallel to first and second cylinder center lines of first and second cylinder banks, respectively.

1 Claim, 5 Drawing Sheets

CYLINDER HEAD STRUCTURE OF INTERNAL COMBUSTION ENGINE

FIELD OF THE INVENTION

The invention relates to a cylinder head structure of an internal combustion engine and, more particularly, to a cylinder head structure which permits a small and light weight internal combustion engine and can improve maintenance efficiency of spark plugs.

BACKGROUND OF THE INVENTION

In an internal combustion engine, particularly, in a 4-cycle internal combustion engine, a valve moving mechanism and spark plugs are provided for the cylinder head. Such a cylinder head structure has been disclosed in JP-A-1-193009 and JP-A-1-280605. According to the cylinder head structure disclosed in JP-A-1-193009, a hydraulic tappet is provided for a rocker shaft to axially support one of the rocker arms, and the other rocker arm is pivotally supported by the hydraulic tappet, thereby simplifying the working of the cylinder head. According to cylinder head structure disclosed in JP-A-1-280605, the forming position of an intake valve and the forming position of an exhaust valve in the width direction perpendicular to the longitudinal direction of the cylinder head are fixed and the cylinder head for the moving valve system is constructed, thereby enabling the outer shape of the cylinder head and the working equipment to be commonly constructed irrespective of the number of intake and exhaust valves and enabling the parts which are used to be also commonly constructed and reducing the costs.

Internal combustion engines are classified into the straight-type, opposed-type, V-type, and the like in accordance with the arrangement of the cylinders. For instance, as shown in FIG. 4, a V-shaped internal combustion engine 102 is constructed in a manner such that first and second cylinder heads 106-1 and 106-2 are mounted on an almost V-shaped cylinder block 104 and first and second cylinder banks 108-1 and 108-2 are arranged in an almost V-shape. One first cam shaft 1101 and one second cam shaft 110-2 are arranged in the first and second cylinder heads 106-1 and 106-2 of the internal combustion engine 102 in the longitudinal direction, respectively. First and second intake valves 112-1 and 112-2 are arranged in the first and second cylinder heads 106-1 and 106-2 on the inner side of the internal combustion engine 102 in the width direction, respectively. First and second exhaust valves 114-1 and 114-2 and first and second spark plugs 116-1 and 116-2 are arranged on the outer edge side of the internal combustion engine 102 in the width direction, respectively. Reference numerals 118-1 and 118-2 denote first and second cylinders; 120-1 and 120-2 first and second intake cams; 122-1 and 122-2 first and second exhaust cams; 124-1 and 124-2 first and second rocker arms; and 126-1 and 126-2 third and fourth rocker arms, respectively.

As shown in FIG. 4, however, the first and second exhaust valves 114-1 and 114-2 and the first and second spark plugs 116-1 and 116-2 are arranged on the outer edge side of the internal combustion engine 102 in the width direction of the first and second cylinder heads 106-1 and 106-2, respectively, so as to be inclined from first and second cylinder center lines 118-1L and 118-2L of the first and second cylinders 118-1 and 118-2. That is, as shown in FIG. 5, the second exhaust valve 114-2 and the second spark plug 116-2 are arranged on the outer edge side of the internal combustion engine 102 in the width direction of the second cylinder head 106-2 in a manner such that a second exhaust valve center line 114-2L and a second spark plug center line 116-2L are inclined from the second cylinder center line 118-2L of the second cylinder 118-2.

Therefore, there is a disadvantage in that the width of the internal combustion engine 102 is enlarged because the first and second exhaust valves 114-1 and 114-2 and the first and second spark plugs 116-1 and 116-2 project from the outer edge side of the internal combustion engine 102. There is also a disadvantage in that the weight of the internal combustion engine 102 is increased, an increase in the size of the engine room of the vehicle is required, and the weight of the vehicle is increased. Since the first and second spark plugs 116-1 and 116-2 are obliquely arranged, there is a problem such that it is difficult to easily attach and detach them. Thus, maintenance efficiency is deteriorated. Further, when an accessory 128 such as a radiator or the like exists on an extension in the spark plug attaching-/detaching direction, the attaching/detaching of the first and second spark plugs 116-1 and 116-2 is difficult and the maintenance efficiency is deteriorated. In order to assure the maintenance efficiency of the internal combustion engine 102, the accessory 128 must therefore be located away from the engine. There is consequently a disadvantage in that an enlargement of the engine room is required and the weight of vehicle is increased In an attempt to solve the above disadvantages, according to the invention, in a cylinder head structure of an internal combustion engine in which first and second cylinder heads are mounted on an almost V-shaped cylinder block and first and second cylinder banks are arranged in an almost V-character shape, wherein a first cam shaft and a second cam shaft are respectively arranged in the longitudinal directions of the first and second cylinder heads of the internal combustion engine, first and second intake valves are respectively arranged on the inner side of the internal combustion engine in the width directions of the first and second cylinder heads, and first and second exhaust valves and first and second spark plugs are respectively arranged on the outer edge side of the internal combustion engine in the width directions of the first and second cylinder heads, the cylinder head structure is characterized in that the first and second cam shafts are respectively arranged so as to be deviated to the inner side of the internal combustion engine in the width directions of the first and second cylinder heads, and the first and second exhaust valves and the first and second spark plugs are respectively arranged so as to be almost parallel to respective center lines of the first and second cylinders.

According to the invention, the first and second cam shafts are respectively arranged so as to be deviated to the inner side of the internal combustion engine in the width directions of the first and second cylinder heads. The first and second exhaust valves and the first and second spark plugs are arranged so as to be almost parallel to the cylinder center lines of the first and second cylinders, respectively. Consequently, the width of the internal combustion engine can be reduced and the spark plugs can be attached/detached from positions over the internal combustion engine on extensions of the cylinder center lines.

BRIEF DESCRIPTION OF THE DRAWINGS

An embodiment of the invention will now be described in detail on the basis of the drawings, in which.

DETAILED DESCRIPTION

Figure 1:
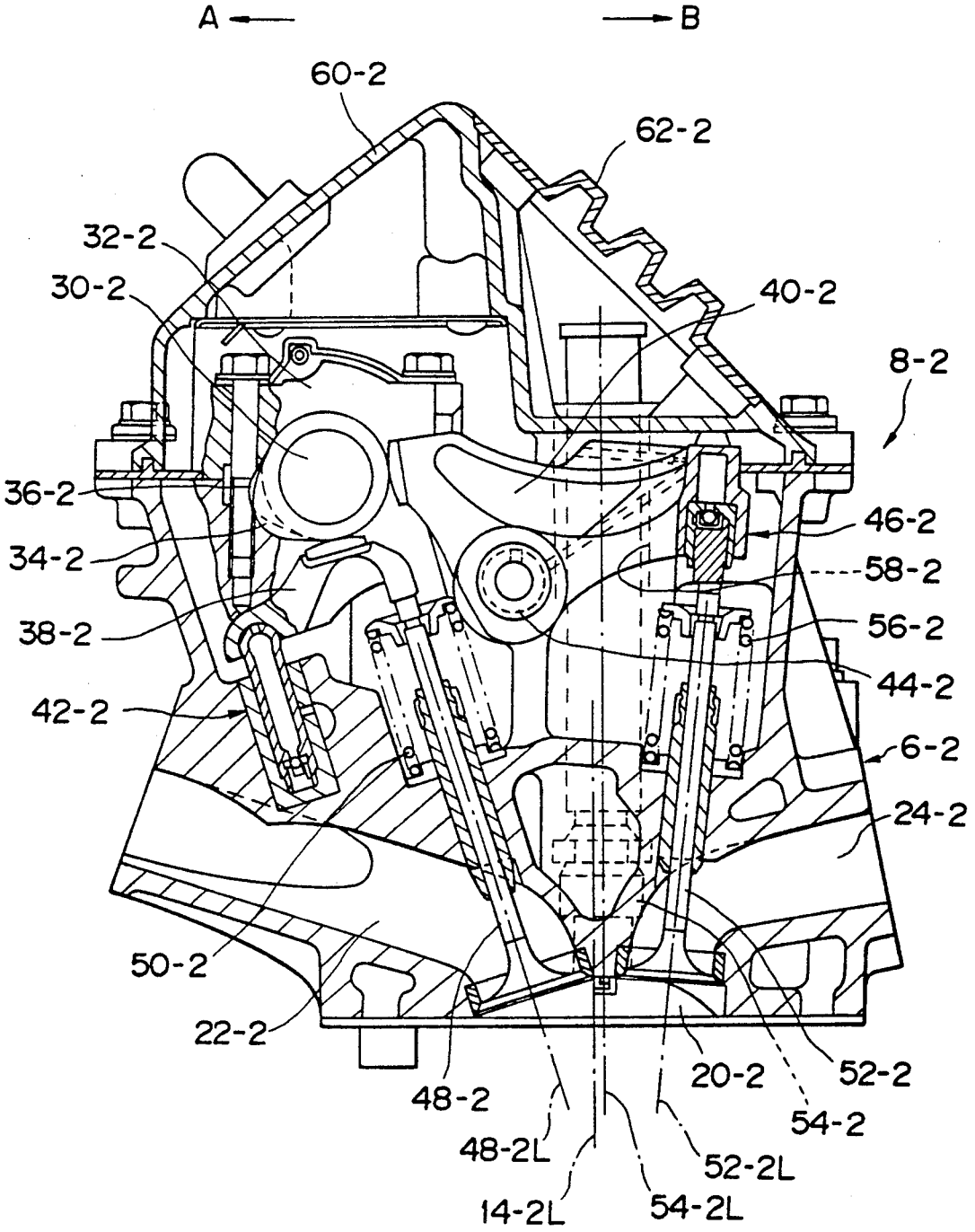
FIG. 1 is an enlarged cross sectional view of a cylinder head of an internal combustion engine showing an embodiment of the invention.
Figure 2:
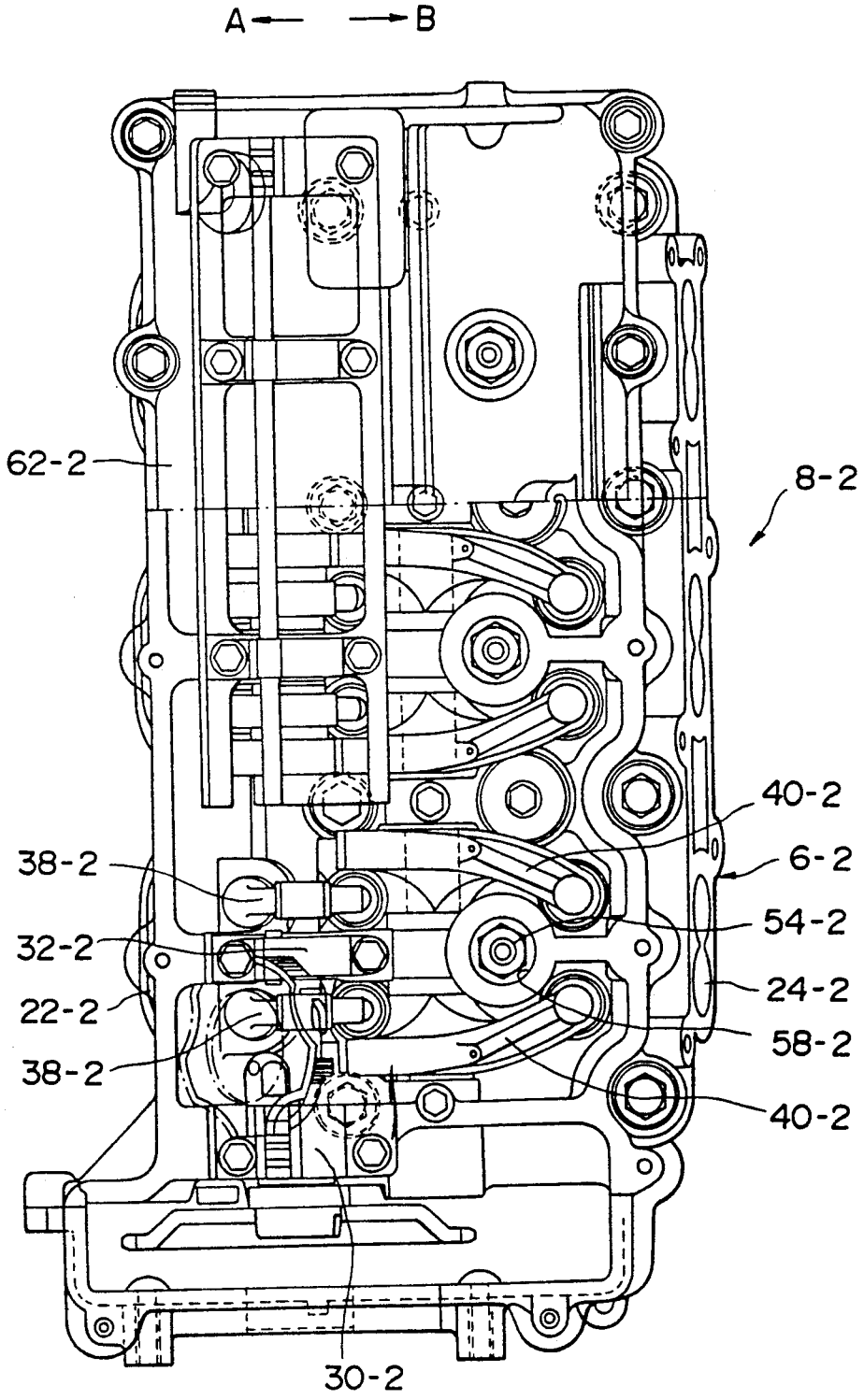
FIG. 2 is an enlarged plan view of the cylinder head of FIG. 1.
Figure 3:
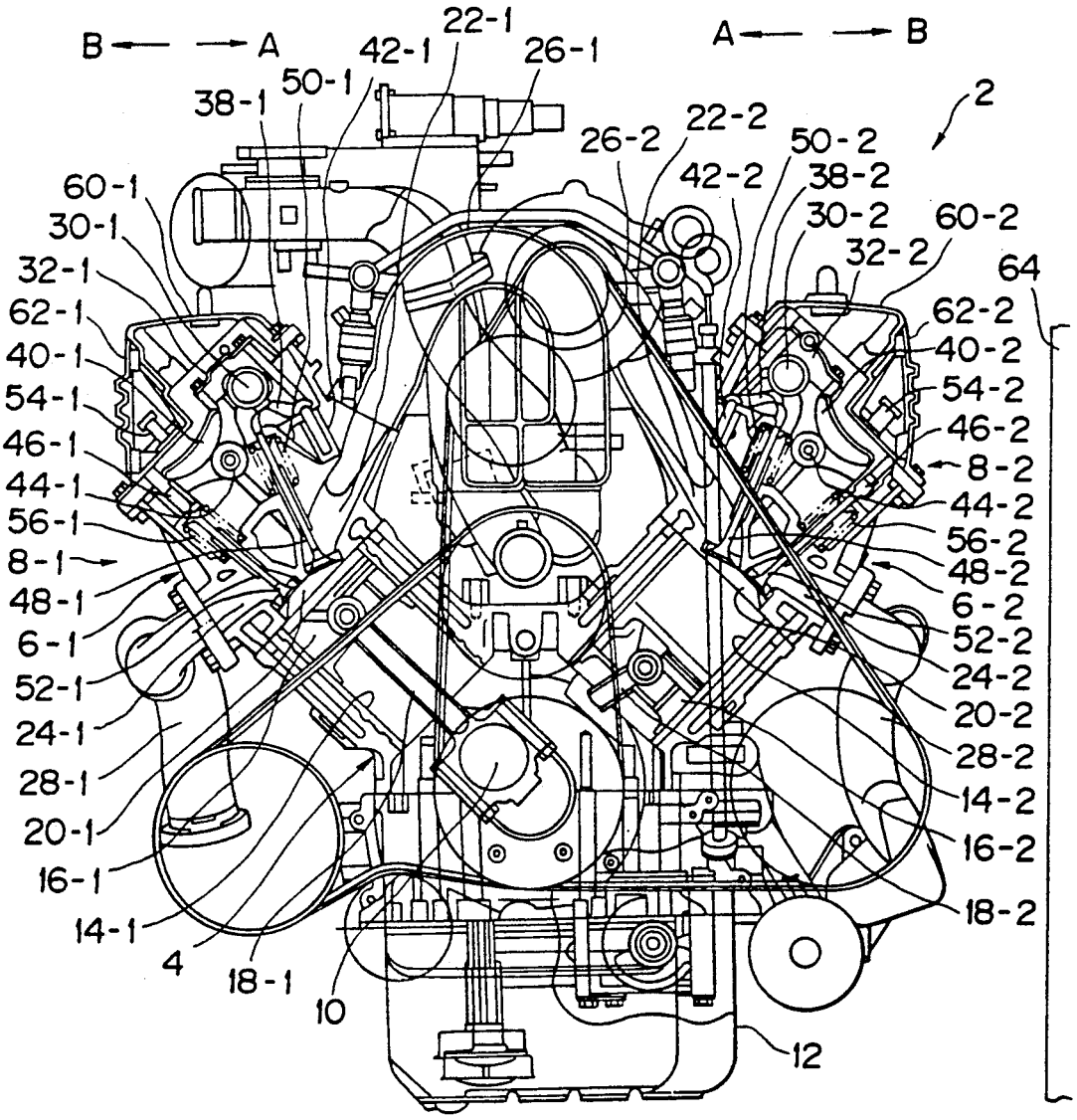
FIG. 3 is a cross sectional view of an internal combustion engine showing the invention.

FIGS. 1 to 3 show one embodiment of the invention.

Referring to FIG. 3, reference numeral 2 denotes an internal combustion engine. According to the internal combustion engine 2, first and second cylinder heads 6-1 and 6-2 are mounted on an almost V-shaped cylinder block 4 and first and second cylinder banks 8-1 and 8-2 are arranged in an almost V-character shape.

One crank shaft 10 is axially supported in the longitudinal direction of the cylinder block 4 and an oil pan 12 is attached to the lower portion of the cylinder block. First and second cylinders 14-1 and 14-2 are provided in the cylinder block 4 and have first and second pistons 16-1 and 16-2 disposed respectively therein. The first and second pistons 16-1 and 16-2 are coupled with the crank shaft 10 by first and second connecting rods 18-1 and 18-2, respectively.

The first and second cylinder heads 6-1 and 6-2 have first and second intake ports 22-1 and 22-2 and first and second exhaust ports 24-1 and 24-2 which are communicated with first and second combustion chambers 20-1 and 20-2 which are formed by the cylinder block 4, first and second cylinder heads 6-1 and 6-2, and first and second pistons 16-1 and 16-2. The first and second intake ports 22-1 and 22-2 are arranged on the inner side of the internal combustion engine 2 in the width directions of the first and second cylinder heads 6-1 and 6-2. The first and second exhaust ports 24-1 and 24-2 are arranged on the outer edge side of the internal combustion engine 2 in the width directions of the first and second cylinder heads 6-1 and 6-2.

First and second intake pipes 26-1 and 26-2 are communicated with the first and second intake ports 22-1 and 22-2. The upstream sides of the first and second intake pipes 26-1 and 26-2 are communicated with a throttle body (not shown). First and second exhaust pipes 28-1 and 28-2 are communicated with the first and second exhaust ports 24-1 and 24-2. The downstream sides of the first and second exhaust pipes 28-1 and 28-2 are opened to the outside air.

A first cam shaft 30-1 and a second cam shaft 30-2 are respectively arranged in the first and second cylinder heads 6-1 and 6-2, in the longitudinal direction. The first and second cam shafts 30-1 and 30-2 are axially supported by first and second cam caps 32-1 and 32-2, respectively. The first and second cam shafts 30-1 and 30-2 have respective intake cams and respective exhaust cams such as illustrated by intake cam 34-2 and exhaust cam 36-2 on cam shaft 30-2 in FIG. 1. The intake cams and the exhaust cams respectively oscillate first and second intake rocker arms 38-1 and 38-2 and first and second exhaust rocker arms 40-1 and 40-2.

The first and second intake rocker arms 38-1 and 38-2 are pivotally supported by first and second intake valve adjusters 42-1 and 42-2. The first and second exhaust rocker arms 40-1 and 40-2 are pivotally supported by first and second exhaust rocker shafts 44-1 and 44-2 and have first and second exhaust valve adjusters 46-1 and 46-2.

First and second intake valves 48-1 and 48-2 to open or close the first and second intake ports 22-1 and 22-2 are arranged in the first and second cylinder heads 6-1 and 6-2 on the inner side (the side in the direction of arrow A in FIGS. 1-3) of the internal combustion engine 2 in the width direction. The first and second intake valves 48-1 and 48-2 are pressed by first and second intake springs 50-1 and 50-2 in such a direction as to close the first and second intake ports 22-1 and 22-2 and are driven by the first and second intake rocker arms 38-1 and 38-2 in such a direction as to open the first and second intake ports 22-1 and 22-2.

First and second exhaust valves 52-1 and 52-2 to open or close the first and second exhaust ports 24-1 and 24-2 and first and second spark plugs 54-1 and 54-2 to combust fuel are arranged in the first and second cylinder heads 6-1 and 6-2 on the outer edge side (the side in the direction of arrow B in FIGS. 1-3) of the internal combustion engine 2 in the width direction. The first and second exhaust valves 52-1 and 52-2 are pressed by first and second exhaust springs 56-1 and 56-2 in such a direction as to close the first and second exhaust ports 24-1 and 24-2 and are driven by the first and second exhaust rocker arms 40-1 and 40-2 in such a direction as to open the first and second exhaust ports 24-1 and 24-2. The first and second spark plugs 54-1 and 54-2 are received in respective spark plug holes (see, e.g., 58-2 in FIGS. 1-2) of the first and second cylinder heads 6-1 and 6-2 so as to face the first and second combustion chambers 20-1 and 20-2, respectively.

Reference numerals 60-1 and 60-2 denote first and second head covers. Reference numerals 62-1 and 62-2 indicate first and second plug covers.

Figure 4:
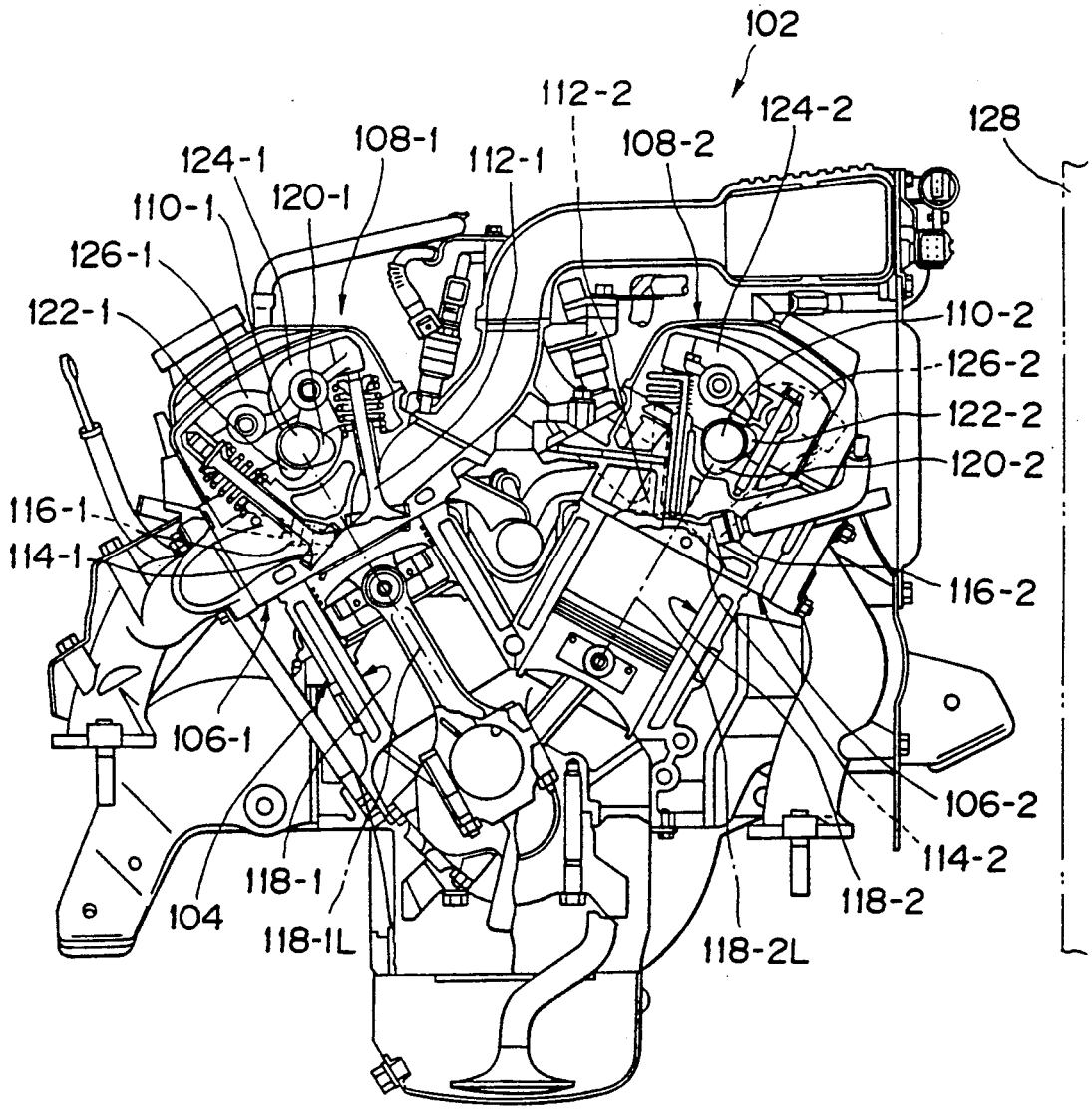
FIG. 4 PRIOR ART
FIG. 4 is a cross sectional view of a conventional internal combustion engine.
Figure 5:
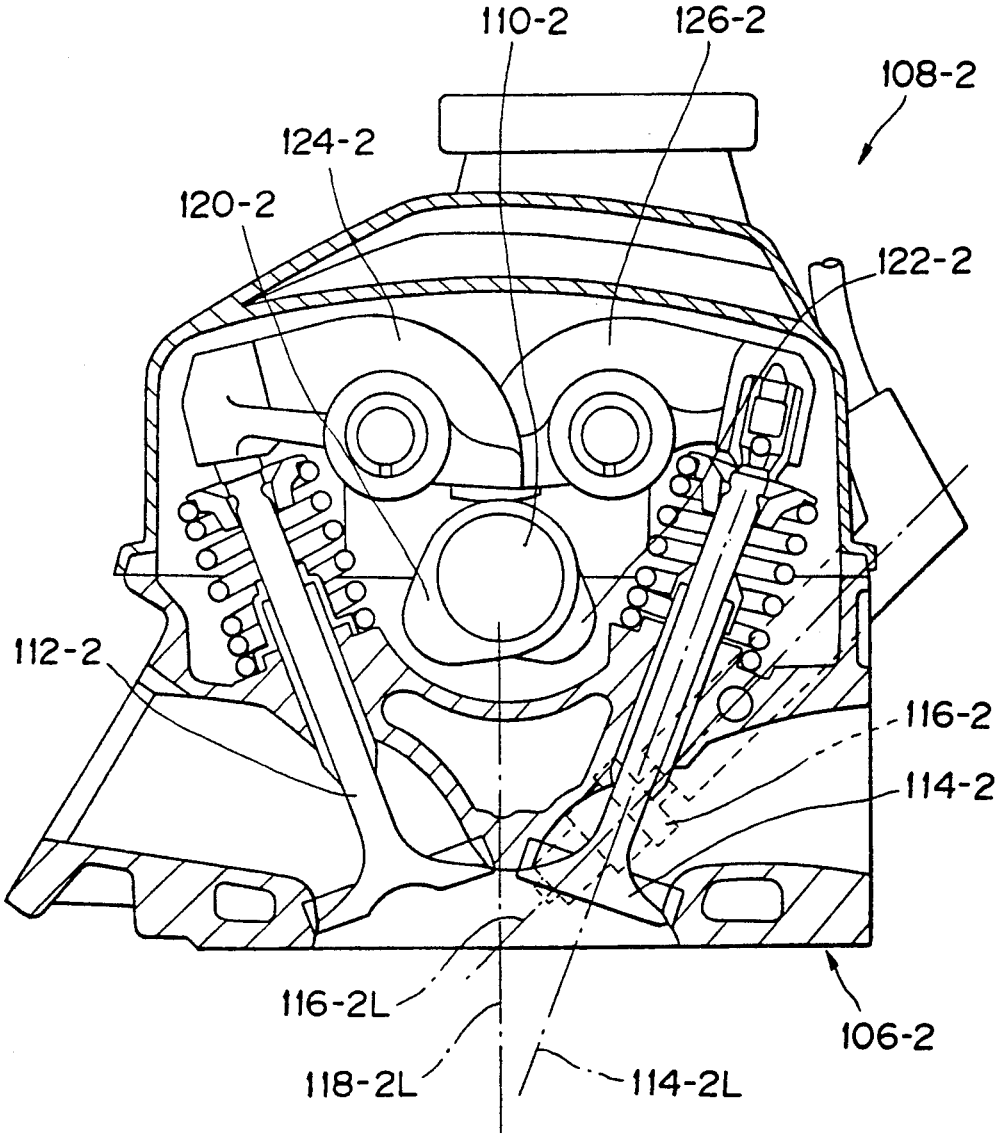
FIG.5 PRIOR ART
FIG. 5 is an enlarged cross sectional view of a cylinder head of the conventional internal combustion engine of FIG. 4.

In the internal combustion engine 2, the first and second cam shafts 30-1 and 30-2 are arranged so as to be deviated (i.e. offset relative to the cam shafts of prior art FIGS. 4-5) to the inner side (the side in the direction of the arrow A) of the internal combustion engine 2 in the width directions of the first and second cylinder heads 6-1 and 6-2. The first and second exhaust valves 52-1 and 52-2 and the first and second spark plugs 54-1 and 54-2 are arranged so as to be almost parallel to respective cylinder center lines (see, e.g., 14-2L in FIG. 1) of the first and second cylinders 14-1 and 14-2.

As mentioned above, the first and second cam shafts 30-1 and 30-2 are arranged so as to be deviated to the inner side of the internal combustion engine 2. The center lines (e.g., 48-2L of FIG. 1) of the first and second intake valves 48-1 and 48-2 are arranged so as to be inclined from the respective cylinder center lines (e.g., 14-2L) of the first and second cylinders 14-1 and 14-2. The center lines (e.g. 52-2L) of the first and second exhaust valves 52-1 and 52-2 and the center lines (e.g., 54-2L) of the first and second spark plugs 54-1 and 54-2 are set to be almost parallel to the respective cylinder center lines.

That is, by arranging the first and second cam shafts 30-1 and 30-2 so as to be closer to the inside of the respective cylinder head than to the outside thereof, the first and second exhaust valves 52-1 and 52-2 and the first and second spark plugs 54-1 and 54-2 can be arranged so as to be almost parallel to the respective cylinder center lines.

Thus, it is possible to prevent the first and second exhaust valves 52-1 and 52-2 and the first and second spark plugs 54-1 and 54-2 from projecting from the outer edge side of the internal combustion engine 2. The width of the internal combustion engine 2 can be reduced. Therefore, the size and weight of the internal combustion engine 2 can be reduced, the engine room of the vehicle in which the internal combustion engine 2 is mounted can be reduced, and the weight of the vehicle can be decreased. The first and second spark plugs 54-1 and 54-2 can be attached or detached from positions over the internal combustion engine 2 on extensions of the cylinder center lines, so that attaching/detaching can be made easy and the maintenance efficiency can be improved. Further, since the first and second spark plugs 54-1 and 54-2 can be attached or detached from the positions over the internal combustion engine 2, there is no interference with an accessory 64, such as a radiator or the like. Even when the accessory 64 is close to the internal combustion engine 2, attaching/detaching of spark plugs is not made difficult. Therefore, since the accessory 64 can be placed close to the internal combustion engine 2, the engine room can be reduced, and such a structure contributes to a decrease in weight of the vehicle.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A V-type internal combustion engine comprising an elongated cylinder block having a pair of cylinder banks arranged in a substantially V-shape with a central space defined therebetween, each of said pair of cylinder banks defining a plurality of cylinder bores, each bore having a longitudinal axis; a pair of cylinder head assemblies affixed to said cylinder banks, respectively, each of said cylinder head assemblies having a plurality of combustion chambers, each chamber opening into one of said cylinder bores of its associated cylinder bank, intake and exhaust ports communicating with each of said combustion chambers, said intake port being located on one side of said longitudinal axis of its associated cylinder bore closer to said central space and said exhaust port being located on the opposite side of said longitudinal axis remote from said central space, intake and exhaust poppet valves for opening and closing said intake and exhaust ports, respectively, said intake and exhaust valves each having an upwardly projecting, elongated stem, a spark plug located between said intake and exhaust valves and having a lower end communicating with said combustion chamber, a valve mechanism chamber in said cylinder head assembly above said combustion chambers, valve operating mechanism disposed in said valve mechanism chamber, said valve stems projecting upwardly into said valve mechanism chamber and being connected to said valve operating mechanism for operation thereby, said valve operating mechanism comprising an elongated, rotatable camshaft disposed in the upper portion of said valve mechanism chamber for rotation about an axis extending lengthwise of said cylinder block, the axis of rotation of said camshaft being offset laterally from the longitudinal axis of said stem of said intake valve in a direction toward said central space of said cylinder block, first and second cams mounted on and rotatable with said cam shaft, an exhaust valve rocker shaft disposed in said valve mechanism chamber substantially between the upper ends of said stems of said intake and exhaust valves, said exhaust valve rocker shaft extending generally parallel with said cam shaft, a first rocker mounted at an intermediate part thereof on said exhaust valve rocker shaft, said first rocker having a first arm which projects in a direction toward said central space, said first arm having a free end slidably engaged with said first cam, said first rocker having a second arm which projects in a direction away from said central space and toward said stem of said exhaust valve, said second arm having a free end drivingly coupled to the upper end of said stem of said exhaust valve so that rotation of said camshaft will open and close said exhaust valve, an intake valve adjuster disposed in said cylinder head assembly at a location offset laterally from the longitudinal axis of said stem of said intake valve in a direction toward said central space, a second rocker having a single arm which is pivotally supported at one end thereof on said intake valve adjuster and is drivingly coupled at the other end thereof to the upper end of said stem of said intake valve, said second cam being maintained in sliding engagement with said second rocker between said ends of said arm thereof so that rotation of said camshaft will open and close said intake valve, said exhaust valve and said spark plug being arranged to extend almost parallel to the longitudinal axis of their associated cylinder.

* * * * *